US006370743B2

(12) United States Patent
Choe

(10) Patent No.: US 6,370,743 B2
(45) **Date of Patent: *Apr. 16, 2002**

(54) SHOELACE TIGHTENING DEVICE

(76) Inventor: Sang- Ceol Choe, #102-1513 Hanbo Apt., 766-1 Sange-dong, Nowon-gu, Seoul (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/408,893

(22) Filed: Sep. 29, 1999

(30) Foreign Application Priority Data

Sep. 30, 1998 (KR) ..... 98-18899

(51) Int. Cl.[7] ..... A43C 7/00; F16G 11/00

(52) U.S. Cl. ..... 24/712; 24/712.1; 24/712.5; 24/712.9

(58) Field of Search ..... 24/712, 712.1, 24/712.2, 712.3, 712.4, 712.5, 712.6, 712.7, 712.8, 712.9; 36/50.1

(56) References Cited

U.S. PATENT DOCUMENTS

| | | | | | |
|---|---|---|---|---|---|
| 748,197 | A | * | 12/1903 | Lyons | 24/712 |
| 882,479 | A | * | 3/1908 | Nicholls | 24/712.5 |
| 1,348,475 | A | * | 8/1920 | Bullock, Jr. | 24/712.9 |
| 2,581,366 | A | * | 1/1952 | Grazia | 24/712.1 |
| 4,680,835 | A | * | 7/1987 | Horng | 24/712.5 |
| 4,884,321 | A | | 12/1989 | Holub | |
| 5,649,342 | A | | 7/1997 | D'Andrade et al. | |
| 5,979,028 | A | * | 11/1999 | Hicks et al. | 24/712.1 |
| 6,119,318 | A | * | 9/2000 | Maurer | 24/712.9 |

FOREIGN PATENT DOCUMENTS

| | | | | |
|---|---|---|---|---|
| FR | 0080351 | * | 3/1963 | 24/712.1 |
| GB | 0004248 | * | of 1895 | 24/712.1 |
| KR | 85-2347 | | 5/1985 | |

* cited by examiner

*Primary Examiner*—Victor N. Sakran

(57) ABSTRACT

Disclosed is a shoelace tightening device. The device comprises a plate member attached to the tongue of a shoe; a longitudinal wall section and a transverse wall section disposed on an upper surface of the plate member; a main through hole and an auxiliary through hole formed in the longitudinal wall section for allowing both ends of a shoelace to be passed therethrough; a first opened groove and a second opened groove formed in the transverse wall section such that they have a contour which is opened at both axial ends and at an upper portion and are spaced apart from each other by a predetermined distance; and a first winding element and a second winding element arranged at places on the plate member where they are separated respectively from the first opened groove and the second opened groove by a preset distance, while they are spaced apart from each other by the predetermined distance, for securing therearound portions of the shoelace which are inserted through the first opened groove and the second opened groove, respectively, after passing through the main through hole of the longitudinal wall section.

17 Claims, 4 Drawing Sheets

SHOELACE TIGHTENING DEVICE

BACKGROUND OF THE INVENTION

1. Field of the Invention

The present invention relates to a shoelace tightening device, and more particularly, the present invention relates to a shoelace tightening device which enables a shoelace to be simply and easily tightened and loosened when putting on and taking off one's shoes, respectively, thereby enhancing convenience of a wearer of shoes and improving the value of shoes.

2. Description of the Related Art

Generally, most sports shoes such as basketball shoes, which are commercially available, possess a feature in that they are manufactured to have an elongated neck portion which defines a foot insertion opening. These sports shoes having elongated neck portions provide advantages in that they effectively protect ankles of a wearer of the sports shoes while ameliorating external appearance of themselves. However, because the sports shoes cannot be put on and taken off in a convenient manner as in dress shoes, when putting on and taking off the sports shoes, inconvenience is caused in that the wearer has to tie and untie shoelaces every time.

Accordingly, in most cases, if sports shoes having elongated neck portions are to be worn, as a usual attempt to resolve even to a slight extent the inconvenience caused when putting on and taking off the sports shoes, each shoelace is not threaded through some of two approximately parallel rows of eyelets, which are proximate to the top of the shoe, and/or each of both ends of the shoelace is independently knotted by being tied several times after being threaded through the eyelets.

However, in the case that, as described above, sports shoes are worn in a state wherein each of both ends of the shoelace is independently knotted by being tied several times after being threaded through the eyelets, while it is easy for the wearer to put on and take off the sports shoes, the sports shoes as a whole have an untidy appearance, and, when participating in athletic activities involving running and jumping which translate to high impact force on the foot, the sports shoes are likely to come off from the feet of the wearer, due to the fact that tightening force of the shoelaces is insufficient.

To cope with these problems, there are disclosed sports shoes with Velcro brand hook and loop fasteners, in the art. These sports shoes have a strap with the Velcro brand hook and loop fastener on one end and the complementary Velcro brand hook and loop fastener on the other end. One end of the strap is attached to one side of the shoe, and the other end of the strap runs through an opening defined on the opposite side of the shoe and then is folded back to be secured to the one end of the strap. If fit properly, fasteners of this type provide a firm fit, but tend to look bulky and unkempt. Additionally, in the case of the sports shoes using the Velcro brand hook and loop fasteners, while an upper portion of an instep of the shoe is sufficiently tightened, a lower portion of the instep of the shoe is relatively loosened. Therefore, wearing comfortableness of the shoe is deteriorated, and the sports shoes cannot be worn by a professional athlete.

As a result, the aforementioned shoes of the conventional art commonly suffer from defects in that convenience of a wearer of shoes is degraded and the value of shoes is lessened.

SUMMARY OF THE INVENTION

Accordingly, the present invention has been made in an effort to solve the problems occurring in the related art, and an object of the present invention is to provide a shoelace tightening device which enables a shoelace to be simply and easily tightened and loosened when putting on and taking off one's shoes, respectively, thereby enhancing convenience of a wearer of shoes and improving the value of shoes.

Another object of the present invention is to provide a shoelace tightening device, by which a shoelace is conveniently knotted in such a manner that tightening force of the shoelace is consistently maintained and thereby the shoelace is not spontaneously untied while a shoe is worn on the foot of a wearer of shoes.

In order to achieve the above object, according to one aspect of the present invention, there is provided a shoelace tightening device, comprising: a plate member attached to the tongue of a shoe; a longitudinal wall section and a transverse wall section disposed on an upper surface of the plate member such that they define a T-shaped configuration when viewed from the top; a main through hole and an auxiliary through hole formed in the longitudinal wall section for allowing both ends of a shoelace to be passed therethrough; a first opened groove and a second opened groove formed in the transverse wall section such that they have a contour which is opened at both axial ends and at an upper portion and are spaced apart from each other by a predetermined distance; and a first winding element and a second winding element arranged at places on the plate member where they are separated respectively from the first opened groove and the second opened groove by a preset distance, while they are spaced apart from each other by the predetermined distance, for securing therearound portions of the shoelace which are inserted through the first opened groove and the second opened groove, respectively, after passing through the main through hole of the longitudinal wall section.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
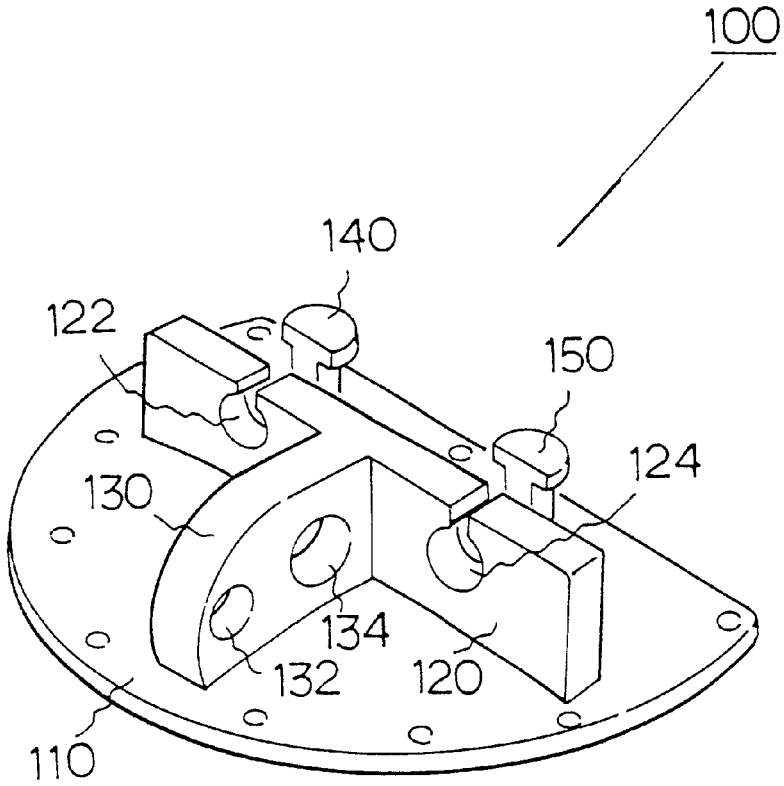
FIG. 1 is a perspective view of a shoelace tightening device in accordance with an embodiment of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
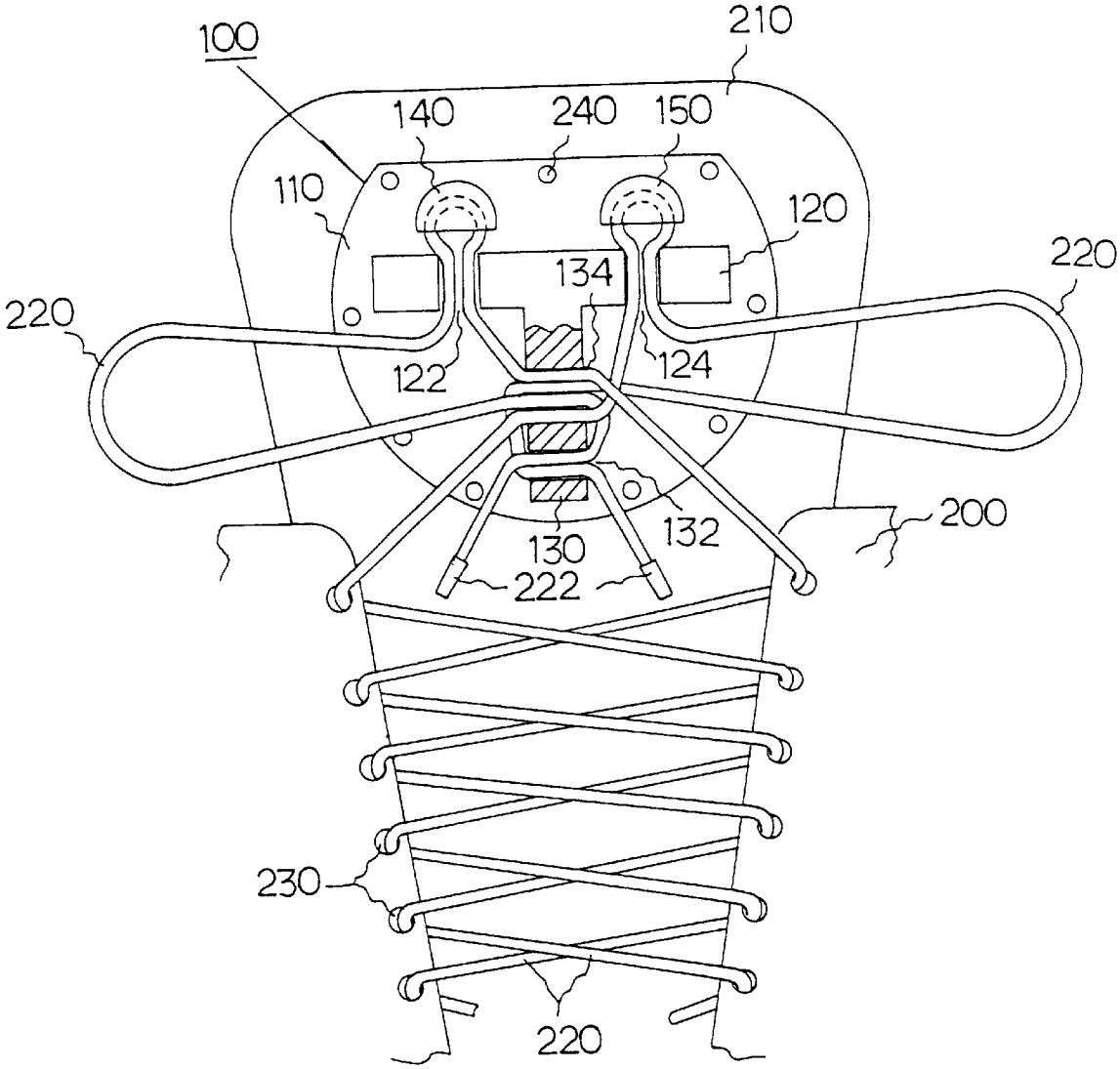
FIG. 2 is a view illustrating a state wherein the shoelace tightening device of FIG. 1 is applied to a shoe.

FIG. 1 is a perspective view of a shoelace tightening device in accordance with an embodiment of the present invention; and FIG. 2 is a view illustrating a state wherein the shoelace tightening device of FIG. 1 is applied to a shoe.

As shown in FIGS. 1 and 2, the shoelace tightening device 100 in accordance with an embodiment of the present invention includes a plate member 110 which is attached to a tongue 210 of a shoe. The plate member 110 is formed such that it has a configuration which is substantially curved upward when viewed from the front, to be brought into close contact with the instep of the foot.

The plate member 110 has a transverse wall section 120 and a longitudinal wall section 130 which are integrally formed with each other. The transverse wall section 120 and the longitudinal wall section 130 are disposed on an upper surface of the plate member 110 such that they define substantially a T-shaped configuration when viewed from the top in a vertical direction. The longitudinal wall section 130 is formed with a main through hole 134 and an auxiliary through hole 132 which are located in a side by side relationship and are spaced apart from each other by a predetermined spacing. The main through hole 134 allows portions of a shoelace 220 which is to be knotted, to be inserted therethrough. The auxiliary through hole 132 allows both ends 222 of the knotted shoelace 220 to be finally inserted therethrough so that both ends 222 of the knotted shoelace 220 are prevented from being released from the auxiliary through hole 132.

The transverse wall section 120 which is integrally formed with the longitudinal wall section 130 while defining a center angle of 90° therebetween, is formed with a first opened groove 122 and a second opened groove 124. The first opened groove 122 and the second opened groove 124 have a contour which is opened at both axial ends and at an upper portion thereof. The first opened groove 122 and the second opened groove 124 are formed such that they are spaced apart from each other by a predetermined distance. A first winding element 140 and a second winding element 150 are projectedly arranged at places on the plate member 110 where they are separated from the first opened groove 122 and the second opened groove 124, respectively, by a preset distance, while they are spaced apart from each other by the predetermined distance. The first winding element 140 and the second winding element 150 function to secure therearound portions of the shoelace 220 which are inserted through the first opened groove 122 and the second opened groove 124 of the transverse wall section 120, respectively, after being passed through the main through hole 134 of the longitudinal wall section 130.

As shown in FIG. 2 of the attached drawings, the shoelace tightening device 100 according to the present invention, constructed as mentioned above, is fixedly secured to the tongue 210 by the fact that a plurality of rivets 240 are riveted along a periphery of the plate member 110.

In this state, in a method for tightening the shoelace 220 thereby to firmly secure the shoe on the foot of a wearer, both ends 222 of the shoelace 220 which are threaded through two approximately parallel rows of eyelets 230 which are formed in an upper shell 200 of the shoe, are first inserted from opposite directions, respectively, through the main through hole 134 which is formed in the longitudinal wall section 130 of the plate member 110.

Both ends 222 of the shoelace 220 which are inserted through the main through hole 134 of the longitudinal wall section 130, as described above, are then inserted, after being bent, through the first opened groove 122 and the second opened groove 124, respectively, which are formed in the transverse wall section 120 such that they are opened at both axial ends and at the upper portion thereof. Thereafter, portions of the shoelace 220 which are adjacent both ends 222 thereof are wound around the first winding element 140 and the second winding element 150 which are projectedly arranged in the vicinity of the first opened groove 122 and the second opened groove 124, respectively. Next, the shoelace 220 having its portions which are wound around the first winding element 140 and the second winding element 150, are knotted after passing through the first opened groove 122 and the second opened groove 124, thereby to define adequate knot patterns. Then, both ends 222 of the shoelace 220 are again inserted and passed through the main through hole 134 of the longitudinal wall section 130. Following this, both ends 222 of the shoelace 220 are finally inserted through the auxiliary through hole 132, to enable the shoelace 220 to be maintained in a firmly tightened state, whereby a tightened situation of the shoelace 220 which does not adversely affect walking, is kept.

At this time, according to the present invention, the main through hole 134 is formed to have a diameter such that four portions of the shoelace 220 are maintained not in a loosely fitted state, but in a tightly fitted state therein after both ends 222 of the shoelace 220 are inserted twice through the main through hole 134 from the opposite directions, respectively, thereby to prevent the knots of the shoelace 220 from being untied. Also, it is preferred that the auxiliary through hole 132 which is located adjoining the main through hole 134 is formed to have a diameter such that both ends 222 of the shoelace 220 which are passed through the main through hole 134 after being knotted in a butterfly knot are tightly inserted therethrough, not to be spontaneously untied from the auxiliary through hole 132.

According to the present invention, the shoelace tightening device 100 has a tightening scheme which allows the shoelace 220 inserted through the main through hole 134 and the auxiliary through hole 132 formed in the longitudinal wall section 130 of the plate member 110 after being knotted, to be more firmly tightened by means of the main through hole 134 and the auxiliary through hole 132. In this connection, due to the fact that, after the portions of the shoelace 220 are inserted through the main through hole 134 and are passed through the first opened groove 122 and the second opened groove 124, respectively, which are formed in the transverse wall section 120, they are wound around the first winding element 140 and the second winding element 150, respectively, even in the case that the wearer of the shoe vigorously participates in exercise which translates to high impact force on the foot while the shoelace 220 is not tied unlike the conventional art, the knotted shoelace 220 is not loosened.

On the other hand, because the first winding element 140 and the second winding element 150 serve as support bars even in the case that external force (tensioning force) is applied to the portions of the shoelace 220 which are inserted through the main through hole 134, the portions of the shoelace 220 which are knotted by being wound around the first winding element 140 and the second winding element 150, are prevented from being untied while the shoe is worn on the foot of the wearer. In this way, the shoelace 220 which is wound around the first winding element 140 and the second winding element 150, is prevented from being spontaneously untied.

Moreover, in the present invention, it is preferred that the upper open portions of the first opened groove 122 and the second opened groove 124 which are formed in the transverse wall section 120, are formed such that the portions of the shoelace 220 are not loosely, but tightly inserted therethrough into the first opened groove 122 and the second opened groove 124, thereby to prevent the portions of the shoelace 220 which are wound around the first winding element 140 and the second winding element 150, respectively, from being untied. At this time, in the case that the wearer does not vigorously participate in exercise after wearing the shoes to which a principle of the present invention is applied, even if the first winding element 140 and the second winding element 150 are not used, the shoelace 220 can be effectively prevented from being untied.

In the meanwhile, in the case that the wearer takes off the shoes, it is possible to conveniently take off the shoes by pulling portions of the shoelace 220 which are arranged between the main through hole 134 and the eyelets 230 proximate to the top of the shoe and then by lengthening lower portions of the shoelace 220.

Figure 3:
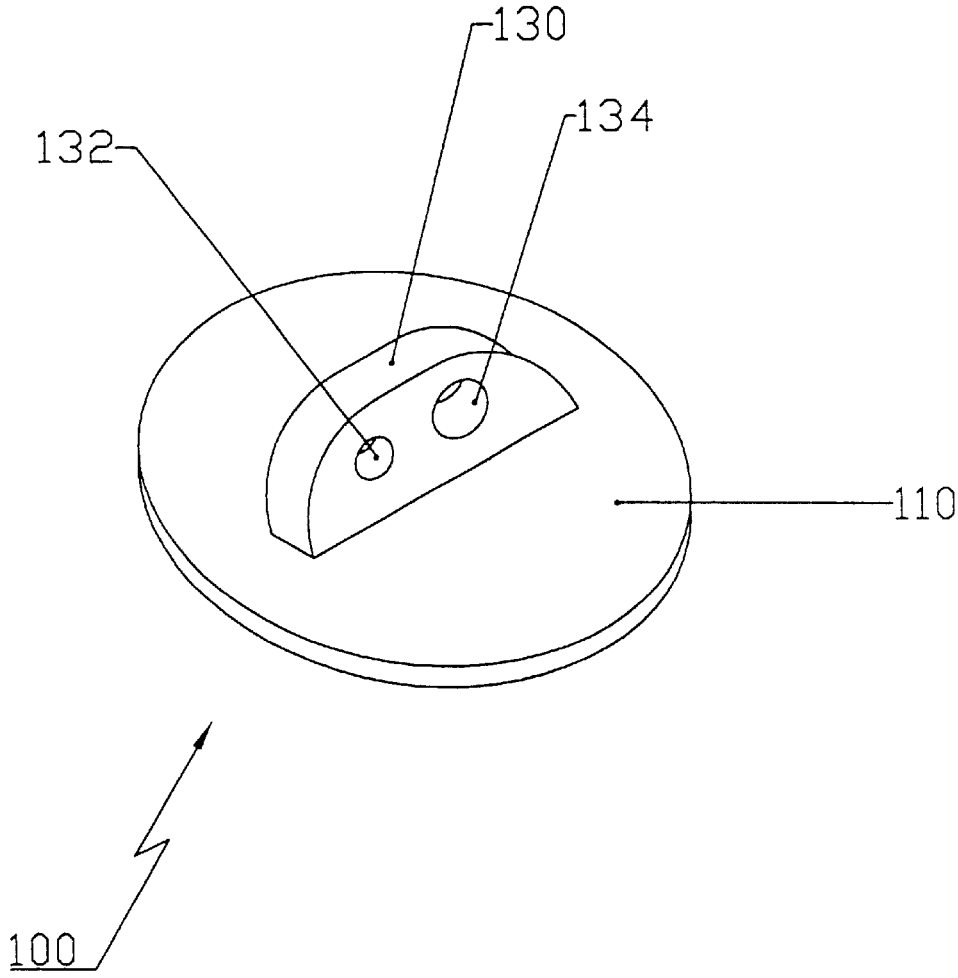
FIG. 3 is a perspective view of a shoelace tightening device in accordance with another embodiment of the present invention.
Figure 4:
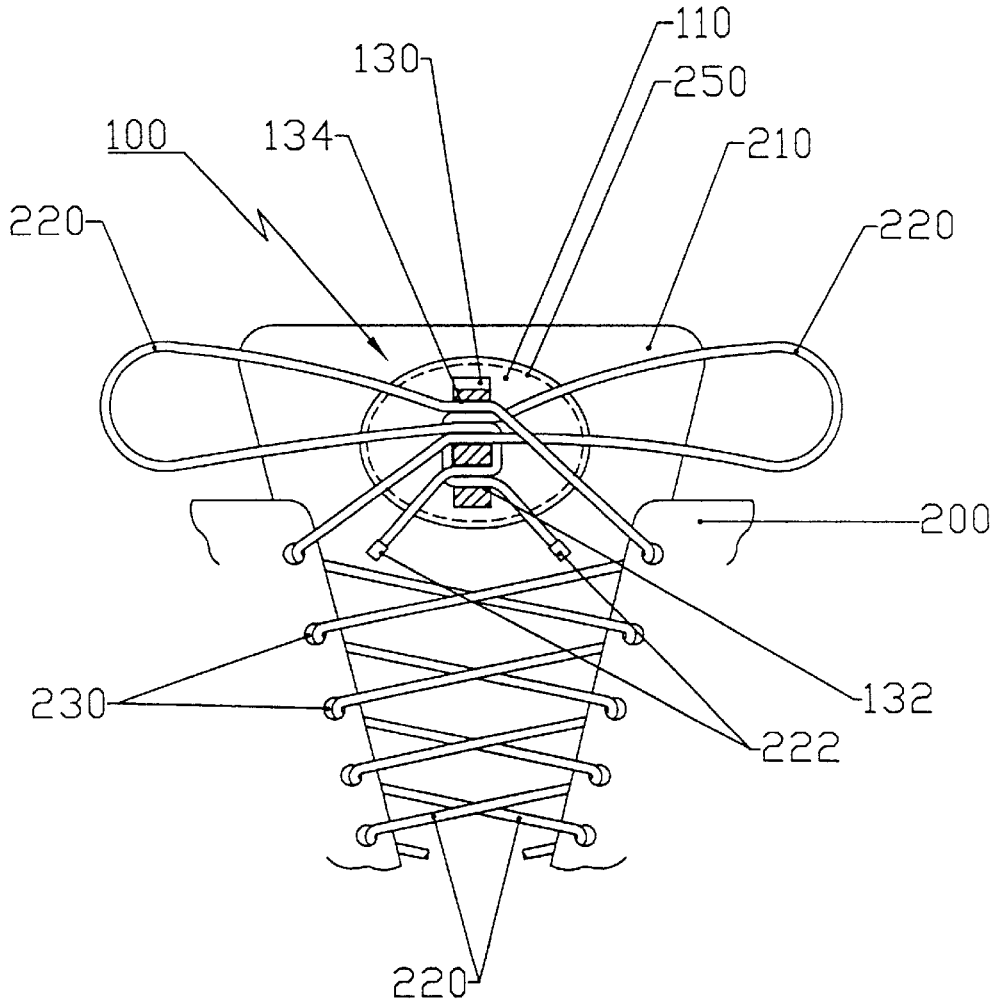
FIG. 4 is a view illustrating a state wherein the shoelace tightening device of FIG. 3 is applied to a shoe.

FIG. 3 is a perspective view of a shoelace tightening device in accordance with another embodiment of the present invention; and FIG. 4 is a view illustrating a state wherein the shoelace tightening device of FIG. 3 is applied to a shoe. In this embodiment of the present invention, only the longitudinal wall section 130 which is formed with the main through hole 134 and the auxiliary through hole 132, is structured using a single piece, and other means provided in the first embodiment are omitted.

In a method for tightening the shoelace 220 thereby to firmly secure the shoe about the foot of the wearer, in accordance with this second embodiment of the present invention, both ends 222 of the shoelace 220 which are threaded through the two approximately parallel rows of eyelets 230 which are formed in the upper shell 200 of the shoe, are first inserted from the opposite directions, respectively, through the main through hole 134 which is formed in the longitudinal wall section 130 of the plate member 110.

Both ends 222 of the shoelace 220 which are inserted through the main through hole 134 of the longitudinal wall section 130, as described above, are then inserted, after being bent, through the auxiliary through hole 132, thereby to allow the shoelace 220 to be finally knotted.

In order to tighten the shoelace 220 in a state wherein the shoelace 220 is knotted as described above, portions of the shoelace 220 which just exit the main through hole 134, are pulled. At this time, because the portions of the shoelace 220 which are inserted through the auxiliary through hole 132 are maintained in a bent state during the course of pulling the portions of the shoelace 220, they resist being pulled, whereby the portions of the shoelace 220 which are inserted into the auxiliary through hole 132 are not willing to be untied, thereby to be maintained in a firmly tightened state.

At this time, since the tightened shoelace 220 is maintained in a squeezed state while being passed through the main through hole 134, a tightened situation of the shoelace 220 which does not adversely affect walking, is kept.

Additionally, the shoelace tightening device 100 in accordance with the second embodiment of the present invention can, as shown in FIG. 4 of the attached drawings, be secured to the tongue 210 by being stitched along a stitching line 250. Besides, only the longitudinal wall section 130 can be exposed outside the tongue 210, and the plate member 110 can be embedded into the tongue 210.

As described above, the shoelace tightening device according to the present invention comprises a plate member attached to the tongue of a shoe; a longitudinal wall section and a transverse wall section disposed on an upper surface of the plate member; a main through hole and an auxiliary through hole formed in the longitudinal wall section for allowing both ends of a shoelace to be passed therethrough; a first opened groove and a second opened groove formed in the transverse wall section such that they have a contour which is opened at both axial ends and at an upper portion and are spaced apart from each other by a predetermined distance; and a first winding element and a second winding element arranged at places on the plate member where they are separated respectively from the first opened groove and the second opened groove by a preset distance, while they are spaced apart from each other by the predetermined distance, for securing therearound portions of the shoelace which are inserted through the first opened groove and the second opened groove, respectively, after passing through the main through hole of the longitudinal wall section.

By the construction of the shoelace tightening device according to the present invention, advantages are provided in that a shoelace can be simply and easily tightened and loosened when putting on and taking off one's shoes, respectively, whereby convenience of a wearer of shoes is enhanced and the value of the shoes is improved. Furthermore, since the shoelace which is properly knotted, is continuously and effectively maintained in a tightened state, even in the case that the wearer vigorously participates in exercise which translates to high impact force on the foot, there is no possibility of the shoelace to be spontaneously untied.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A shoelace tightening device, comprising:

a plate configured to be attached to a tongue of a shoe, the plate having an upper surface; and a first longitudinal wall protruding from the upper surface of the plate and positioned substantially in the middle of the plate, the first longitudinal wall defining a through-hole configured to allow a shoelace to frictionally pass therethrough and defining an additional through-hole, wherein the through-hole is sized to allow a shoelace to pass therethrough at least four times and the additional through-hole is sized to allow a shoelace to pass therethrough at least twice, and wherein the through-hole and the additional through-hole are positioned off-center, with respect to each other.

2. The device as defined in claim 1, wherein the longitudinal wall is substantially vertically protruded from the upper surface of the plate.

3. A shoelace tightening device, comprising:

a plate configured to be attached to a tongue of a shoe, the plate having an upper surface;

a first longitudinal wall protruding from the upper surface of the plate, the first longitudinal wall defining a through-hole configured to allow a shoelace to frictionally pass therethrough; and a second longitudinal wall protruding from the upper surface, wherein the first and second longitudinal walls are substantially perpendicular to each other, and wherein the second longitudinal wall has a top and defines at least one groove from the top.

4. The device as defined in claim 3, wherein the groove is sized to allow a shoelace to pass therethrough at least twice.

5. The device as defined in claim 3, wherein the groove is narrowest at the top of the second longitudinal wall.

6. The device as defined in claim 3, further comprising at least one projection near the groove of the second longitudinal wall, the projection substantially vertically projecting from the upper surface of the plate.

7. The device as defined in claim 6, wherein the vertical projection comprises a stem and a top portion, and wherein the stem is slimmer than the top portion.

8. A shoe comprising:

a tongue;

a substantially flat member having upper and lower surfaces, the lower surface being fixing to the tongue; and a longitudinal wall protruding from the upper surface of the flat member and positioned substantially in the middle of the plate, the wall defining a through-hole sized to allow a shoelace to frictionally pass therethrough and defining an additional through-hole, wherein the through-hole is sized to allow a shoelace to pass therethrough at least four times and the additional through-hole is sized to allow a shoelace to pass therethrough at least twice, and wherein the through-hole and the additional through-hole are positioned off-center, with respect to each other.

9. The shoe as defined in claim 8, wherein the through-hole is sized to allow a shoelace to pass therethrough at least four times.

10. The shoe as defined in claim 8, wherein the shoe comprises an athletic shoe.

11. A shoe comprising:

a tongue;

a substantially flat member having upper and lower surfaces, the lower surface being fixed to the tongue;

a longitudinal wall protruding from the upper surface of the flat member, the wall defining a through-hole sized to allow a shoelace to frictionally pass therethrough; and an additional longitudinal wall protruding from the upper surface, and wherein the additional longitudinal wall protruding from the upper surface, and wherein the additional longitudinal wall defines at least one groove sized to allow a shoelace to pass therethrough at least twice.

12. The device as defined in claim 11, wherein the groove is narrowest at the top of the second longitudinal wall.

13. The device as defined in claim 11, further comprising at least one post substantially vertically protruding from the upper surface of the plate.

14. The device as defined in claim 13, wherein the post comprises a stem and a top portion, and wherein the stem is slimmer than the top portion.

15. A method of tightening a shoelace having two ends, comprising:

passing a first end of the shoelace through a through-hole in a first direction, wherein the through-hole is provided in a longitudinal wall substantially vertically protruding from a plate attached to a tongue of a shoe and configured to allow a shoelace to frictionally pass therethrough;

returning and passing the first end through the through-hole in a second direction opposite the first direction, while leaving a portion of the shoelace forming a loop;

passing a second end of the shoelace through the through-hole in the second direction;

returning and passing the second end through the through-hole in the first direction, while leaving another portion of the shoelace forming a loop;

passing a first end of the shoelace through an additional through-hole in a first direction;

passing a second end of the shoelace through the through-hole in the second direction; and wherein the through-hole is sized to allow a shoelace to pass therethrough at least four times and the additional through-hole is sized to allow a shoelace to pass therethrough at least twice.

16. The method as defined in claim 15, further comprising:

passing the first end through another through-hole in the first direction; and passing the second end through the other through-hole in the second direction.

17. The method as defined in claim 15, further comprising, before the returning and passing the first end, winding a portion of the shoelace around a post protruding from the plate.

* * * * *